US009777550B2

(12) United States Patent
Doane et al.

(10) Patent No.: US 9,777,550 B2
(45) Date of Patent: Oct. 3, 2017

(54) DEGRADABLE CASING SEAL CONSTRUCTION FOR DOWNHOLE APPLICATIONS

(71) Applicants: James Doane, Friendswood, TX (US); Wayne Furlan, Cypress, TX (US); Ping Duan, Cypress, TX (US); Sayantan Roy, Houston, TX (US); Anil Sadana, Houston, TX (US)

(72) Inventors: James Doane, Friendswood, TX (US); Wayne Furlan, Cypress, TX (US); Ping Duan, Cypress, TX (US); Sayantan Roy, Houston, TX (US); Anil Sadana, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 243 days.

(21) Appl. No.: 14/552,003

(22) Filed: Nov. 24, 2014

(65) Prior Publication Data

US 2016/0145964 A1 May 26, 2016

(51) Int. Cl.
*E21B 33/12* (2006.01)

(52) U.S. Cl.
CPC ..... *E21B 33/1208* (2013.01)

(58) Field of Classification Search
CPC ..... E21B 33/1208; E21B 33/10; E21B 23/08
See application file for complete search history.

(56) References Cited

U.S. PATENT DOCUMENTS 6,949,491 B2 9/2005 Cooke, Jr.
7,353,879 B2 4/2008 Todd et al.
2007/0181224 A1 8/2007 Marya et al.
2009/0030507 A1 1/2009 Klocke et al.
2011/0046721 A1 2/2011 Arps
2012/0318513 A1* 12/2012 Mazyar ..... C25D 5/48 166/304
2013/0043041 A1* 2/2013 McCoy ..... E21B 34/063 166/373
2013/0062063 A1* 3/2013 Baihly ..... E21B 23/04 166/297
2013/0292123 A1* 11/2013 Murphree ..... E21B 34/14 166/308.1
2014/0014339 A1 1/2014 O'Malley et al.

OTHER PUBLICATIONS

International Preliminary Report on Patentability; International Application No. PCT/US2015/056809; International Filing Date: Oct. 22, 2015; dated May 30, 2017; pp. 1-10.

* cited by examiner

*Primary Examiner* — Brad Harcourt
(74) *Attorney, Agent, or Firm* — Cantor Colburn LLP

(57) ABSTRACT

In one aspect, a degradable apparatus is disclosed, including: an inner core with a first degradation rate in a downhole environment; an outer sheath disposed around an outer extent of the inner core with a second degradation rate less than the first degradation rate in the downhole environment. In another aspect, a method of temporarily sealing a downhole zone is disclosed, including: providing an inner core with a first degradation rate in a downhole environment; providing an outer sheath disposed around an outer extent of the inner core with a second degradation rate less than the first degradation rate in the downhole environment; sealing the downhole zone with the outer sheath; exposing the outer sheath to the downhole environment; and exposing the inner core to the downhole environment.

24 Claims, 2 Drawing Sheets

DEGRADABLE CASING SEAL CONSTRUCTION FOR DOWNHOLE APPLICATIONS

BACKGROUND

This disclosure relates generally to controllably degradable materials and systems that utilize same for downhole applications.

BACKGROUND OF THE ART

Wellbores are drilled in subsurface formations for the production of hydrocarbons (oil and gas). Hydrocarbons are trapped in various traps or zones in the subsurface formations at different depths. In order to facilitate the production of oil and gas, it is often desired to utilize fracturing operations. During fracturing operations, downhole plugs and corresponding seals are utilized to isolate zones to prevent and limit fluid flow. Such plugs and corresponding seals must be removed or otherwise destroyed before production operations can begin. Such removal operations may be costly and/or time consuming. It is desired to provide a material that can provide a downhole seal while providing desired and predictable degradable characteristics over a wide range of temperatures for the desired time of operations and applications.

The disclosure herein provides controlled degradable materials and systems using the same to withstand down hole conditions.

SUMMARY

In one aspect, a degradable apparatus is disclosed, including: an inner core with a first degradation rate in a downhole environment; an outer sheath disposed around an outer extent of the inner core with a second degradation rate less than the first degradation rate in the downhole environment.

In another aspect, a method of temporarily sealing a downhole zone is disclosed, including: providing an inner core with a first degradation rate in a downhole environment; providing an outer sheath disposed around an outer extent of the inner core with a second degradation rate less than the first degradation rate in the downhole environment; sealing the downhole zone with the outer sheath; exposing the outer sheath to the downhole environment; and exposing the inner core to the downhole environment.

In another aspect, a downhole system is disclosed, including: a casing string disposed in a wellbore; and a casing seal configured to seal against the casing string, including: an inner core with a first degradation rate in a downhole environment; an outer sheath disposed around an outer extent of the inner core with a second degradation rate less than the first degradation rate in the downhole environment.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DESCRIPTION OF THE EMBODIMENTS

Figure 1:
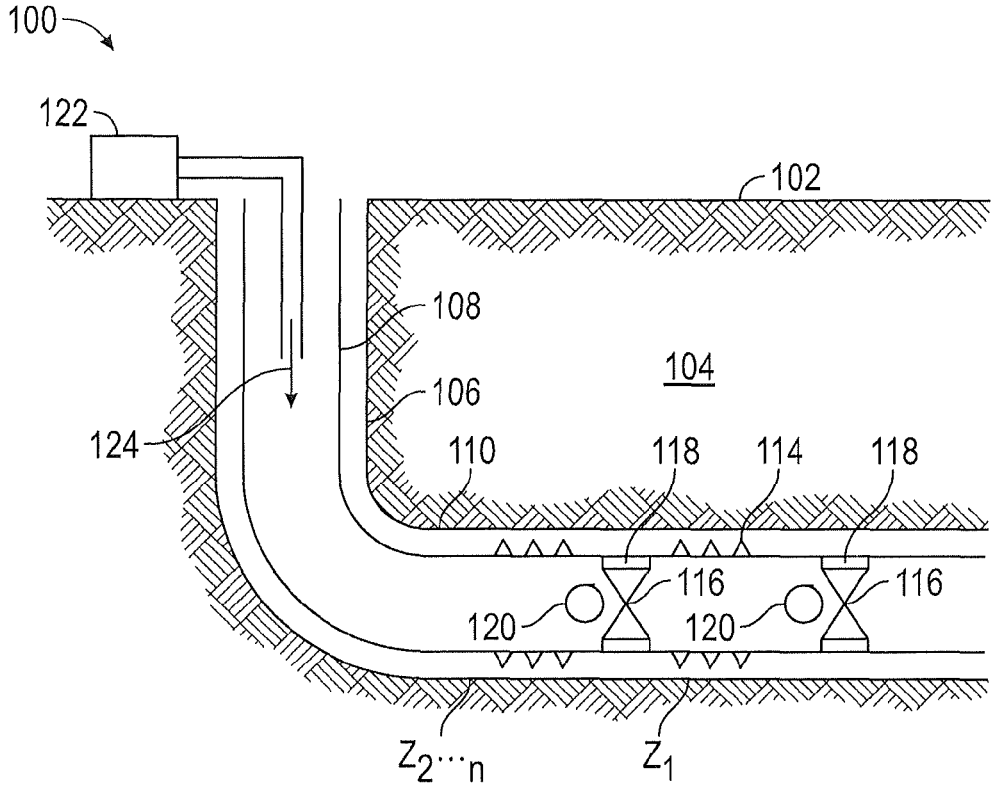
FIG. 1 is a schematic diagram of an exemplary drilling system that includes downhole elements according to embodiments of the disclosure.

FIG. 1 shows an exemplary embodiment of a downhole system for fracturing (or fracing) operations to facilitate the production of oil and gas. System 100 includes a wellbore 106 formed in formation 104 with casing 108 disposed therein.

In an exemplary embodiment, a wellbore 106 is drilled from a surface 102 to a downhole location 110. Casing 108 may be disposed within wellbore 106 to facilitate production. In an exemplary embodiment, casing 108 is disposed through multiple zones of production Z1 . . . Zn in a downhole location 110. Wellbore 106 may be a vertical wellbore, a horizontal wellbore, a deviated wellbore or any other suitable type of wellbore or any combination thereof.

To facilitate fracturing operations, in an exemplary embodiment, frac plugs 116 are utilized within casing string 108. In certain embodiments, frac plugs 116 are utilized in conjunction with casing seals 118 and frac balls 120 to isolate zones Z1 . . . Zn for fracturing operations. In an exemplary embodiment, frac plugs 116 utilize casing seals 118 to seal plugs 116 against casing 108 of local zone 112 to prevent fluid flow therethrough. In certain embodiments, frac balls 120 are disposed at a downhole location 110 to obstruct and seal fluid flow in local zone 112 to facilitate flow to perforations 114.

In an exemplary embodiment, frac fluid 124 is pumped from a frac fluid source 122 to a downhole location 110 to flow through perforations 114 in a zone 112 isolated by frac plug 116 and frac ball 120. Advantageously, fracturing operations allow for more oil and gas available for production.

After fracturing operations, and before production operations, casing seals 118 are often removed or otherwise destroyed to allow the flow of oil and gas through casing 108. In an exemplary embodiment, casing seals 118 are configured to seal against casing 108 of local zone 112 until a predetermined time at which casing seals 118 dissolve to facilitate the production of oil and gas. In various applications, downhole conditions may vary, causing degradation to occur at different rates. Advantageously, in an exemplary embodiment, the casing seals 118 herein are formed of a degradable two part construction to have predictable and adjustable degradation characteristics for various downhole temperature ranges.

Figure 2:
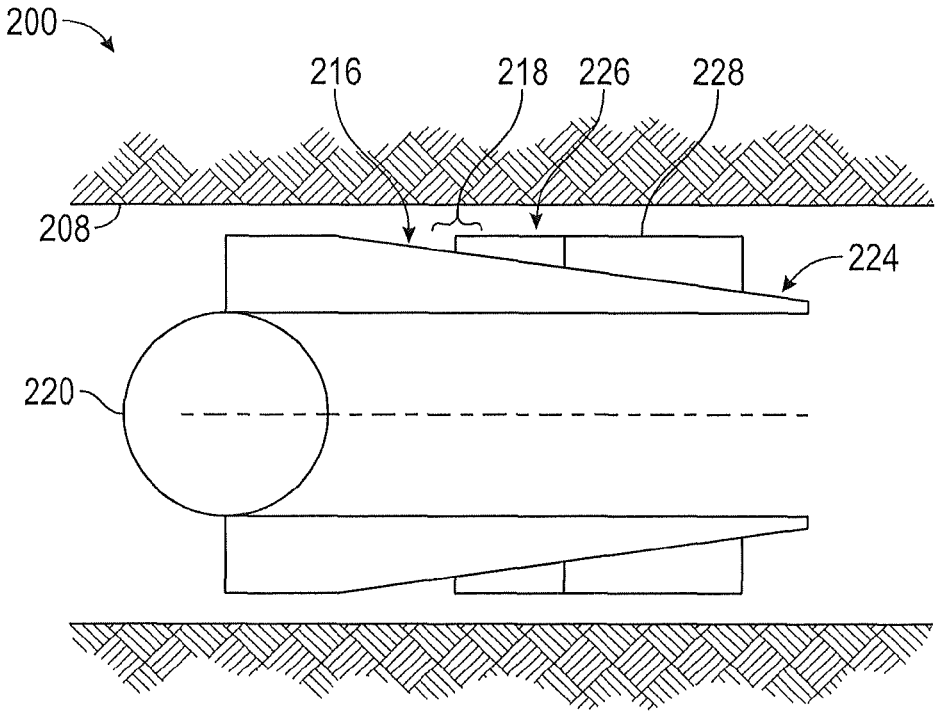
FIG. 2 is a schematic diagram of an exemplary frac plug for use in a downhole system, such as the one shown in FIG. 1, according to one embodiment of the disclosure.

FIG. 2 shows a frac plug 216 for use downhole systems such as the system 100 shown in FIG. 1 for fracturing operations. In an exemplary embodiment, frac plug system 200 includes frac plug 216 interfacing with casing 208 via casing seal 218 and slip 228 to create a seal to isolate a zone for fracturing operations. In certain embodiments, frac plug 216 further receives frac ball 220 to isolate frac fluid flow.

In an exemplary embodiment, casing seal 218 includes a wedge 224 and a casing sealing member 226. In certain embodiments, wedge 224 is forced downhole to force casing sealing member 226 outward against casing 208 to seal against casing 208. In certain embodiments, wedge 224 is forced via a setting tool, explosives, or any other suitable means. In certain embodiments, frac plug 216 further utilizes a slip 228 to position frac plug 216 with respect to casing 208 and further resist movement. Slip 228 may similarly be driven toward casing 208 via wedge 224.

In an exemplary embodiment, casing sealing member 226 is formed of degradable materials. In an exemplary embodiment, the sealing member 226 is formed of two materials of different degradation rates for a given environment, to allow desired sealing characteristics while additionally allowing for the desired amount of degradation in varying downhole conditions with respect to the core and sheath of sealing member 226. In downhole applications, downhole temperature may vary. In certain embodiments, the downhole temperature exposure to frac plug 216 varies from 100 to 350 degrees Fahrenheit at a particular downhole location for a given area. In certain embodiments, the temperature range of exposure may be larger or smaller. Typically, single element degradable seals that are designed to degrade at a certain temperature may degrade too slowly or fail to degrade at a lower temperature, while at an elevated temperature, the seal may degrade too quickly to perform desired functions. Advantageously, by utilizing casing sealing member 226 as described herein, a single frac plug 226 design may be utilized for various wells and well applications with a wide range of downhole temperatures, reducing costs and time compared to conventional solutions that may require a specially designed frac plug for a narrow temperature range.

Figure 3:
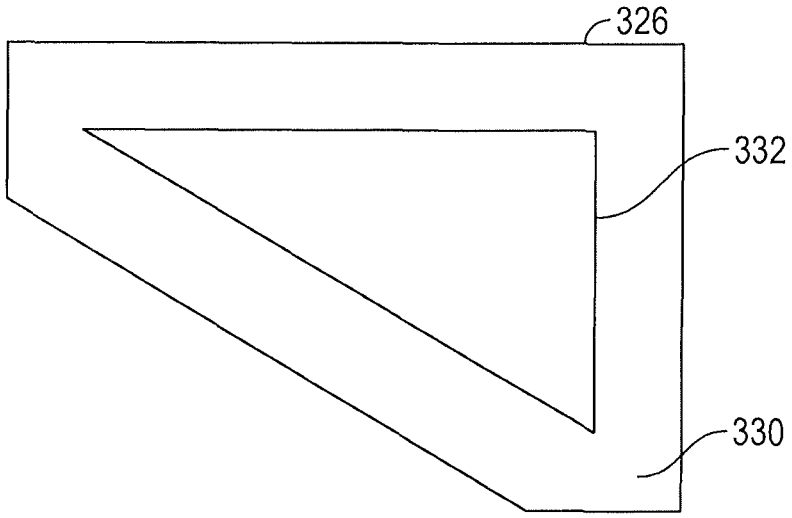
FIG. 3 shows a view of an exemplary casing sealing member for use with the frac plug, such as the frac plug shown in FIG. 2 for use with a downhole system, according to one embodiment of the disclosure.

FIG. 3 shows an exemplary embodiment of a casing seal 326 with an outer sheath 330 and an inner core 332. In an exemplary embodiment, outer sheath 330 is a polymeric composition and inner core 332 is a polymeric material altered to degrade at a faster rate than the outer sheath 330.

In an exemplary embodiment, casing seal 326 and outer sheath 330 generally have a wedge like shape, to facilitate sealing with the casing as described above. The thickness of outer sheath 330 is adjusted to make sure the sealing function is first performed before degradation of the core 332 is initiated.

In an exemplary embodiment, outer sheath 330 is formed of a polymeric material. In an exemplary embodiment, outer sheath 330 has a degradation rate that is contingent on the temperature of the fluid or environment in the wellbore. The base material 330 can include a polymer formed with isocyanates and a di-amine. In certain embodiments, the base material can include a polymer that includes TDI, MDI, PPDI, Polyether, polyesther, polycaprolactone, and polycarbonates. The polymers may further include PC-PPDI, PC-MDI, PD-TDI, Ether-PPDI, Ether-MDI, Ether-TDI, Esther-PPDI, Ester-MDI, and Ester-TDI. In an exemplary embodiment, material of outer sheath 330 can be chosen due to the sensitivity to downhole conditions, degradation characteristics, and sealing characteristics. In an exemplary embodiment, outer sheath 330 is relatively thin and made of a material to generally degrade slower than core 332.

In an exemplary embodiment, core 332 supports outer sheath 330. In an exemplary embodiment, outer sheath 330 is disposed around the outer extents of core 332 to form casing sealing member 326. In an exemplary embodiment, core 332 is formed of a material designed to degrade at a faster rate than the degradation rate of outer sheath 330. Advantageously, after sealing member 326 has performed sealing functions, and the outer sheath 330 has degraded sufficiently to expose core 332, the core 332 may dissolve rapidly. The relative size, thickness, and surface area of outer sheath 330 and core 332 may be adjusted to determine the desired degradation characteristic.

In an exemplary embodiment, core 332 is formed from a combination of materials. In certain embodiments, the core 332 is formed from polymer, sand, cement, glass, or a combination thereof. In an exemplary embodiment, core 332 is formed from a polymer with an additional component to increase degradation in a downhole environment. In an exemplary embodiment, core 332 includes a corrodible material, such as a corrodible metal. In certain embodiments, the corrodible metal is a controlled electrolytic metallic (CEM) material, including, but not limited to, Intallic. In certain embodiments, core 332 includes a corrodible powder that is readily mixed with a polymer or other suitable material. In an exemplary embodiment, core 332 is formed with a mix of polymer and a corrodible powder including, but not limited to adipic acid or citric acid.

Figure 3A:
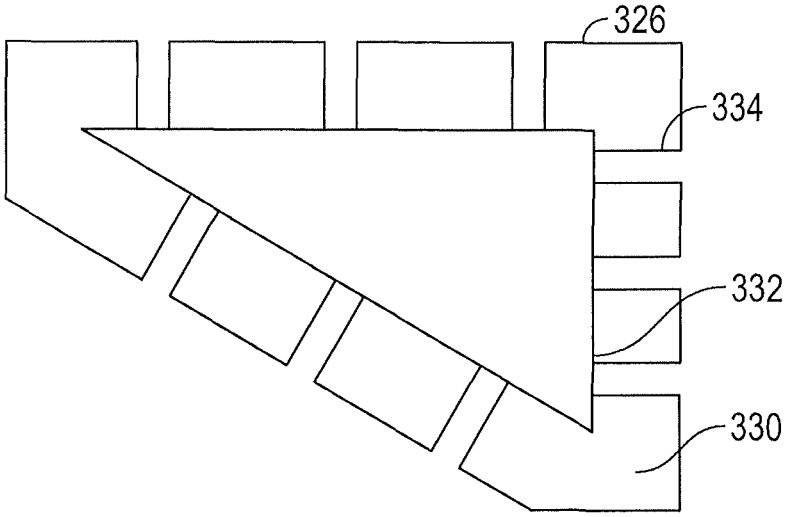
FIG. 3A shows a view of another embodiment of a casing sealing member for use with the frac plug, such as the frac plug shown in FIG. 2 for use with a downhole system, according to another embodiment of the disclosure.

FIG. 3A shows an alternative embodiment of a casing seal 326 that further includes fluid communication channels 334. In an exemplary embodiment, fluid communication channels 334 allow downhole liquids to communicate with an inner core 332 to allow the inner core 332 to degrade at a faster rate before outer sheath 330 has degraded to expose inner core 332. Advantageously, core 332 may degrade faster, causing outer sheath 330 to deform and degrade faster. Further, after core 332 has degraded, degradation of outer sheath 330 may be expedited by exposing additional inner surface area of outer sheath 330. In certain embodiments, chemicals released from degradation of core 332 can accelerate the degradation of outer sheath 330. In other embodiments, fluid communication channel 334 are selectively formed or drilled into outer sheath 330 depending on an intended application. For example, if casing seal 326 is to be used in a high temperature environment (i.e. 350 F) casing seal 326 may be installed without any fluid communication channels 334 to delay degradation of casing seal 326. In certain embodiments, if casing seal 326 is to be used in a relatively lower temperature environment (i.e. 100 F) casing seal 326 can be installed with fluid communication channels 334 to accelerate degradation of casing seal 326.

Therefore in one aspect, a degradable apparatus is disclosed, including: an inner core with a first degradation rate in a downhole environment; an outer sheath disposed around an outer extent of the inner core with a second degradation rate less than the first degradation rate in the downhole environment. In certain embodiments, the downhole environment has a temperature greater than 100 degrees Fahrenheit and less than 350 degrees Fahrenheit. In certain embodiments, the downhole environment includes a salt water content. In certain embodiments, the outer sheath is formed in a wedge shape. In certain embodiments, the outer sheath is configured to seal against a casing. In certain embodiments, the outer sheath is formed of at least one of a group consisting of: TDI, MDI, PPDI, polyether, polyesther, polycaprolactone, and polycarbonate. In certain embodiments, the core is formed of at least one of a group consisting of: polymer, controlled electrolytic metallic, adipic acid, and citric acid. In certain embodiments, further including at least one fluid communication channel formed through the outer sheath to expose the inner core to the downhole environment. In certain embodiments, degradation of the inner core accelerates degradation of the outer sheath.

In another aspect, a method of temporarily sealing a downhole zone is disclosed, including: providing an inner core with a first degradation rate in a downhole environment; providing an outer sheath disposed around an outer extent of the inner core with a second degradation rate less than the first degradation rate in the downhole environment; sealing the downhole zone with the outer sheath; exposing the outer sheath to the downhole environment; and exposing the inner core to the downhole environment. In certain embodiments, the downhole environment has a temperature of at least 100 degrees Fahrenheit and no greater than 350 degrees Fahrenheit. In certain embodiments, the downhole environment includes a salt water content. In certain embodiments, the outer sheath is formed in a wedge shape. In certain embodiments, the outer sheath is configured to seal against a casing. In certain embodiments, the outer sheath is formed of at least one of a group consisting of: TDI, MDI, PPDI, polyether, polyesther, polycaprolactone, and polycarbonate. In certain embodiments, the core is formed of at least one of a group consisting of: polymer, controlled electrolytic metallic, adipic acid, and citric acid. In certain embodiments, further including forming at least one fluid communication channel formed through the outer sheath to expose the inner core to the downhole environment. In certain embodiments, degradation of the inner core accelerates degradation of the outer sheath. In certain embodiments, further including selectively forming at least one fluid communication channel formed through the outer sheath to expose the inner core to the downhole environment in response to a downhole environment temperature.

In another aspect, a downhole system is disclosed, including: a casing string disposed in a wellbore; and a casing seal configured to seal against the casing string, including: an inner core with a first degradation rate in a downhole environment; an outer sheath disposed around an outer extent of the inner core with a second degradation rate less than the first degradation rate in the downhole environment. In certain embodiments, the downhole environment has a temperature of at least 100 degrees Fahrenheit and no greater than 350 degrees Fahrenheit. In certain embodiments, the downhole environment includes a salt water content. In certain embodiments, the outer sheath is formed in a wedge shape. In certain embodiments, the outer sheath is configured to seal against a casing. In certain embodiments, the outer sheath is formed of at least one of a group consisting of: TDI, MDI, PPDI, polyether, polyesther, polycaprolactone, and polycarbonate. In certain embodiments, further including at least one fluid communication channel formed through the outer sheath to expose the inner core to the downhole environment. In certain embodiments, degradation of the inner core accelerates degradation of the outer sheath.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A degradable apparatus, comprising:

an inner core with a first degradation rate in a downhole environment;

an outer sheath disposed around an outer extent of the inner core that degrades at a second degradation rate less than the first degradation rate in the downhole environment, wherein the outer sheath is configured to seal against a casing.

2. The apparatus of claim 1, wherein the downhole environment has a temperature greater than 100 degrees Fahrenheit and less than 350 degrees Fahrenheit.

3. The apparatus of claim 1, wherein the downhole environment includes a salt water content.

4. The apparatus of claim 1, wherein the outer sheath is formed in a wedge shape.

5. The apparatus of claim 1, wherein the outer sheath is formed of at least one of a group consisting of: TDI, MDI, PPDI, polyether, polyesther, polycaprolactone, and polycarbonate.

6. The apparatus of claim 1, wherein the core is formed of at least one of a group consisting of: polymer, controlled electrolytic metallic, adipic acid, and citric acid.

7. The apparatus of claim 1, further comprising at least one fluid communication channel formed through the outer sheath to expose the inner core to the downhole environment.

8. The apparatus of claim 7, wherein degradation of the inner core accelerates degradation of the outer sheath.

9. A method of temporarily sealing a downhole zone, comprising:

providing an inner core with a first degradation rate in a downhole environment;

providing an outer sheath disposed around an outer extent of the inner core that degrades at a second degradation rate less than the first degradation rate in the downhole environment;

sealing the downhole zone with the outer sheath, wherein the outer sheath is configured to seal against a casing;

exposing the outer sheath to the downhole environment;

degrading the outer sheath in response to exposure to the downhole environment; and exposing the inner core to the downhole environment.

10. The method of claim 9, wherein the downhole environment has a temperature of at least 100 degrees Fahrenheit and no greater than 350 degrees Fahrenheit.

11. The method of claim 9, wherein the downhole environment includes a salt water content.

12. The method of claim 9, wherein the outer sheath is formed in a wedge shape.

13. The method of claim 9, wherein the outer sheath is formed of at least one of a group consisting of: TDI, MDI, PPDI, polyether, polyesther, polycaprolactone, and polycarbonate.

14. The method of claim 9, wherein the core is formed of at least one of a group consisting of: polymer, controlled electrolytic metallic, adipic acid, and citric acid.

15. The method of claim 9, further comprising forming at least one fluid communication channel through the outer sheath to expose the inner core to the downhole environment.

16. The method of claim 15, wherein degradation of the inner core accelerates degradation of the outer sheath.

17. A downhole system, comprising:

a casing string disposed in a wellbore; and a casing seal configured to seal against the casing string, including:

an inner core with a first degradation rate in a downhole environment;

an outer sheath disposed around an outer extent of the inner core that degrades at a second degradation rate less than the first degradation rate in the downhole environment.

18. The system of claim 17, wherein the downhole environment has a temperature of at least 100 degrees Fahrenheit and no greater than 350 degrees Fahrenheit.

19. The system of claim 17, wherein the downhole environment includes a salt water content.

20. The system of claim 17, wherein the outer sheath is formed in a wedge shape.

21. The system of claim 17, wherein the outer sheath is configured to seal against a casing.

22. The system of claim 17, wherein the outer sheath is formed of at least one of a group consisting of: TDI, MDI, PPDI, polyether, polyesther, polycaprolactone, and polycarbonate.

23. The system of claim 17, further comprising at least one fluid communication channel formed through the outer sheath to expose the inner core to the downhole environment.

24. The system of claim 23, wherein degradation of the inner core accelerates degradation of the outer sheath.

* * * * *